US005909082A

United States Patent [19]

Speaker et al.

[11] Patent Number: 5,909,082

[45] Date of Patent: Jun. 1, 1999

[54] STARTING AID FOR HIGH INTENSITY DISCHARGE LAMPS

[75] Inventors: Lawrence W. Speaker, Louisville, Ky.; Byron R. Collins, Tuxedo, N.C.

[73] Assignee: General Electric Company, Schenectady, N.Y.

[21] Appl. No.: 08/851,912

[22] Filed: May 6, 1997

[51] Int. Cl.[6] ..... H01J 17/20

[52] U.S. Cl. ..... 313/570; 313/594; 313/601

[58] Field of Search ..... 313/25, 484, 569, 313/570, 573, 580, 594, 601, 607, 620, 634; 315/344, 289, 290

[56] References Cited

U.S. PATENT DOCUMENTS

| | | | |
|---|---|---|---|
| 3,828,214 | 8/1974 | Keefe et al. | 313/15 |
| 4,048,539 | 9/1977 | Walker et al. . | |
| 4,053,809 | 10/1977 | Fridrich et al. | 313/113 |
| 4,788,475 | 11/1988 | Jacobs | 315/183 |
| 5,047,693 | 9/1991 | Roberts et al. . | |
| 5,059,868 | 10/1991 | El-Hamamsy et al. . | |

OTHER PUBLICATIONS

Block, "Lighting Handbook, Eigth Edition," The Illuminating Engineering Society of North America, New York, New York (1993), p. 219 and copyright page.

Byszewski et al., "Enhanced Starting of HID Lamps," Journal of the Illuminating Engineering Society, Summer 1990, pp. 70–75.

Cohen et al., "Heat Starting a High–Pressure Sodium Lamp," Journal of IES, Jul. 1974, pp. 330–335.

Collins et al., "HPS lamps for use on HPM ballasts," Lighting Design and Application (Illuminating Engineering Society of North America), Sep. 1975, pp. 18–24.

Gregor et al., "Arc Tube Transparency Loss Due to Starting of HID Lamps," Journal of the Illuminating Engineering Society, Summer 1996, pp. 150–159.

Nortrup et al., "Pulse Start of Metal Halide Lamps for Improved Lumen Maintenance," Journal of the Illuminating Engineering Society, Summer 1996, pp. 113–116.

Waymouth et al., "Sodium Loss Processes in Metal Iodide Arc Lamps," Illuminating Engineering, Apr. 1967, pp. 314–220.

Wyner, "Electrolysis of sodium through alumina arc tubes," Journal of IES, Apr. 1979, pp. 166–173.

*Primary Examiner*—Vip Patel

*Attorney, Agent, or Firm*—Charles E. Bruzga, Esq.

[57] ABSTRACT

A high intensity discharge lamp comprises an elongated, main arc tube containing a gas fill. First and second in-leads are connected to first and second electrodes within the arc tube, with an arc gap being defined in the arc tube between the electrodes. The fist and second in-leads are adapted to be connected to first and second power leads of a ballast circuit. A starting aid is included for the main arc tube and comprises a path generally parallel to the main arc tube along the arc gap and which is conductive during starting of the main arc tube; an electron barrier disposed between the path and the main arc tube for preventing a substantial amount of photoelectrons from collecting on an outer surface of the main arc tube; and first and second ends of the path being coupled to the first and second in-leads by first and second electrical couplings. The claimed invention enables cold starting of an IUD lamp at higher fill pressures than previously used, for better lamp performance, and enables hot starting of an HID lamp while avoiding the damaging photoelectron effect.

26 Claims, 5 Drawing Sheets

FIG. 3
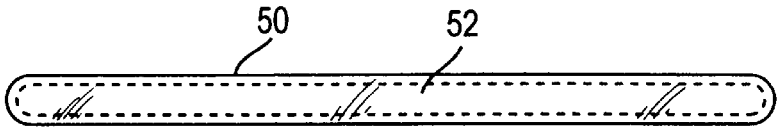
FIG. 4A
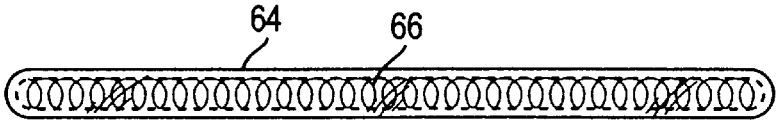
FIG. 4B
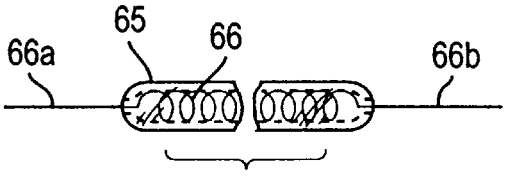
FIG. 5A
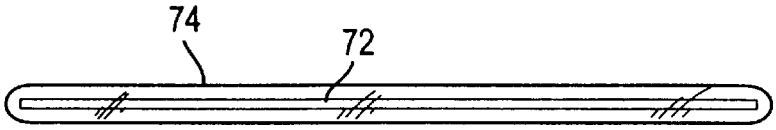
FIG. 5B
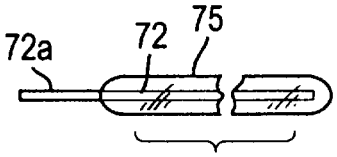
FIG. 5C
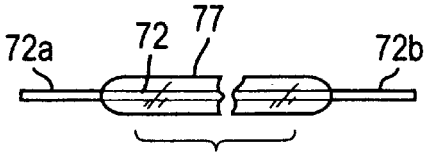
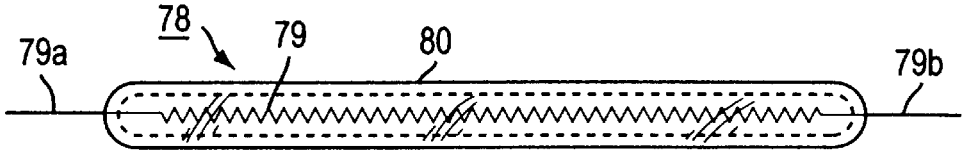
FIG. 6

STARTING AID FOR HIGH INTENSITY DISCHARGE LAMPS

Field of the Invention

The present invention relates to high intensity discharge lamps, and, more particularly, to an aid for assisting in starting a high intensity discharge lamp.

Background of the Invention

High intensity discharge (HID) lamps are one class of high pressure discharge lamps. As a class, HID lamps often face the challenge of creating an arc discharge through a gaseous fill, to start the lamp. To enable an HID lamp to start from a cold state, i.e., without residual heat from prior operation, it has been the practice to provide a low arc tube fill pressure of typically 20–30 Torr. However, this has resulted in degradation of lamp performance compared to having a higher fill pressure in the cold state. Moreover, the pressure of the fill increases with increasing lamp temperature as a byproduct of normal lamp operation. HID lamps of the metal halide type have faced particularly significant problems in starting, especially when the lamp was already hot.

A key problem relates to placing a conductor generally parallel to the arc tube of a lamp to assist in lamp starting. Such a conductive starting aid has been used in fluorescent lamps, for instance. However, the use of such a conductive starting aid with a metal halide HID lamp has not been deemed feasible, because lamp life would rapidly attenuate. This is due to the photoelectron effect, whereby energetic photons from the lamp arc tube would impinge upon the starting aid and cause the release of electrons therefrom. Such "photoelectrons" would accumulate on the outer wall of the arc tube, creating a negative electric field, and inducing sodium ions to migrate out of the arc tube. The sodium loss quickly attenuates the lamp life.

SUMMARY OF THE INVENTION

Thus, there is a particular need for an HID lamp to avoid the foregoing problem. An exemplary embodiment of the invention provides a high intensity discharge lamp comprising an elongated, main arc tube containing a gas fill. First and second in-leads are connected to first and second electrodes within the arc tube, with an arc gap being defined in the arc tube between the electrodes. The first and second in-leads are adapted to be connected to first and second power leads of a ballast circuit. A starting aid is included for the main arc tube and comprises a path generally parallel to the main arc tube along the arc gap and which is conductive during starting of the main arc tube; an electron barrier disposed between the path and the main arc tube for preventing a substantial amount of photoelectrons from collecting on an outer surface of the main arc tube; and first and second ends of the path being coupled to the first and second in-leads by first and second electrical couplings.

The claimed invention enables cold starting of an HID lamp at higher fill pressures than previously used, for better lamp performance, and enables hot starting of an HID lamp while avoiding the damaging photoelectron effect.

DESCRIPTION OF THE DRAWINGS

FIGS. 3–6 are simplified side views of different implementations of starting aid 18 of FIG. 1, shown without the curves of FIG. 1 for convenience, and with FIGS. 4B, 5B, and 5C being fragmentary views.

DESCRIPTION OF THE INVENTION

Figure 1:
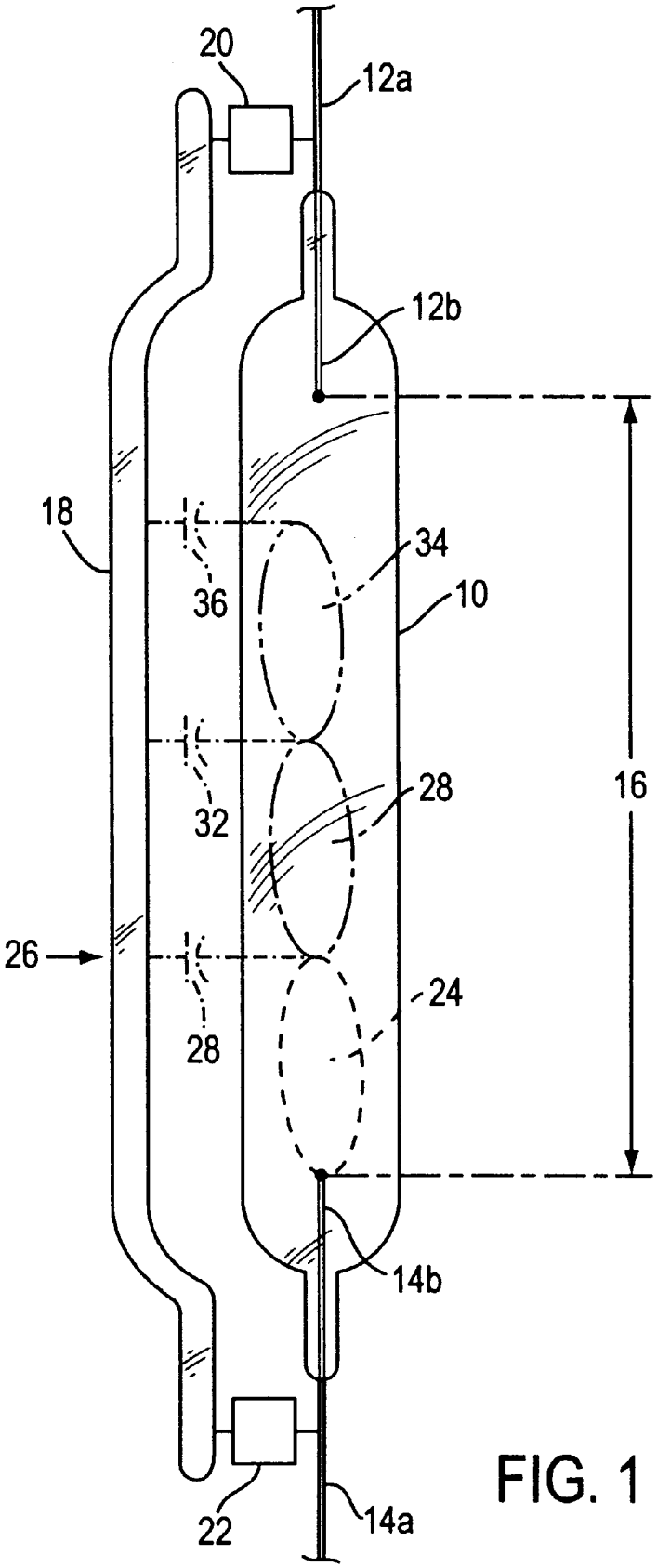
FIG. 1 is a simplified view, partially in block diagram form, of selected portions of a HID lamp with a conductive starting aid.

FIG. 1 shows an arc tube 10 with an upper end through which an in-lead 12*a* extends, and with a lower end through which an in-lead 14*a* extends. The inleads are respectively connected to electrodes 12*b* and 14*b*, which are spaced apart within arc tube 10 by an arc gap whose length is designated 16. Arc tube 10 contains a suitable fill of materials for supporting an arc discharge in the arc tube, between electrodes 12*b* and 14*b*. By way of example, such materials may include a metal halide.

A starting aid 18 runs generally parallel to arc tube 10 for at least about 75 percent of length 16 of the arc gap, and, more preferably, for at least about 90 percent of the length 16. Aid 18 is conductive during starting of arc tube 10. An electrical coupling 20 couples the upper portion of starting aid 18 to in-lead 12*a*, while electrical coupling 22 couples the lower portion of aid 18 to in-lead 14*a*. In this manner, aid 18 is provided with current via in-leads 12*a* and 14*a*. Couplings 20 and 22, shown in block diagram form, are selected to limit the current through starting aid 18 to a tolerable level, and will be described in further detail below.

Arc tube 10 and starting aid 18 may, if desired, be enclosed within an outer transparent, vitreous jacket (not shown), typically of glass or quartz.

As presently understood by the inventors, starting aid 18 facilitates an arc discharge in arc tube 10 in the following manner. During both cold and hot starting, the voltage between electrodes 12*b* and 14*b* is typically insufficient to establish an arc discharge across the entire arc gap, of length 16. However, with current flowing in the starting aid, a short discharge within a zone 24 is enabled from electrode 14*b* to the wall of the arc tube at the level shown by arrow 26, and then to the aid at level 26 via an inherent capacitive coupling 28 between the arc tube and aid. The thus-established arc ionizes the gas within zone 24 to create a zone of free electrons, referred to herein as a conductivity zone.

Once conductivity zone 24 is created, the voltage between electrodes 12*b* and 14*b* is still typically insufficient to establish an arc discharge across the remaining distance to electrode 12*b*. However, in the same manner as the just-described creation of conductivity zone 24, a further conductivity zone 28 associated with capacitive coupling 32 to aid 18 is created; and, in iterative fashion, a still further conductivity zone 34 associated with capacitive coupling 36 is created. Zone 34 extends sufficiently upwards so that the breakdown voltage from zone 34 to electrode 12 is less than the breakdown voltage from zone 34 to aid 18. Then, when zones 24, 28 and 34 become sufficiently populated with free electrons from the ionizing effect of the arc discharge within the zones, the discharge becomes extended from zone 34 to electrode 12*b*, to facilitate lamp starting. In practice, a great many (or continuous succession of) conductivity zones are created, rather than just the three shown for simplicity.

En practice, the spacing between aid 18 and arc tube 10 is chosen to provide adequate capacitive coupling (e.g., 28, 32 and 36) to create the described effect. It will typically be less than as shown in FIG. 1.

Figure 2A:
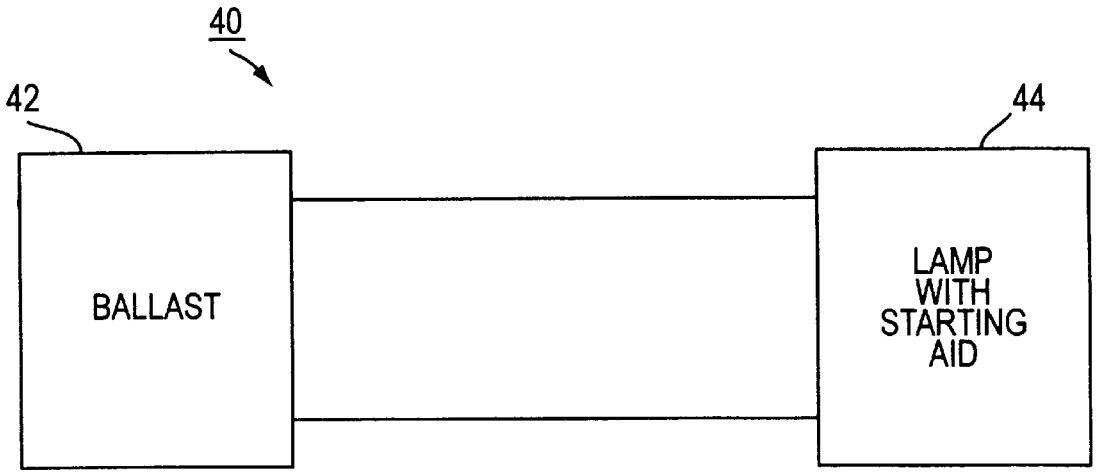
FIG. 2A is a circuit diagram in block diagram form of a ballast circuit for the HID lamp of FIG. 1, and FIGS. 2B and 2C show alternative waveforms of voltage applied by the ballast circuit.
Figure 2B:
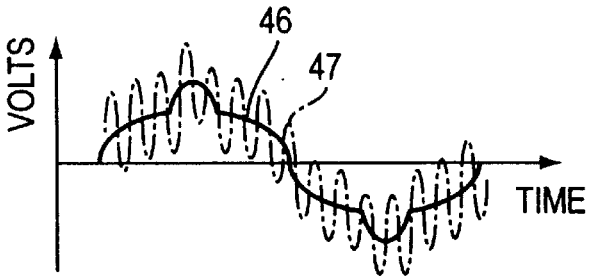

FIG. 2A shows a ballast circuit 40 preferably used to power the HID lamp of FIG. 1. A ballast circuit 42 powers lamp 44, which includes a starting aid, such as shown in FIG. 1. As shown in FIG. 2B, ballast circuit 42 preferably provides a ballast signal having a low frequency component 46, shown as a solid line, with a typical frequency of 60 hertz, and also having a substantially higher frequency component 47, shown in dashed lines, with a typical frequency of 60 kilohertz. The high frequency component is used for starting the lamp; the low frequency component is used for powering the lamp in normal operation. The magnitude of high frequency component 47 is shown greatly reduced for ease of illustration; it typically may have a peak voltage on the order of several thousand volts, whereas component 46 typically has a peak voltage on the order of hundreds of volts. As taught in U.S. Pat. No. 4,048,539 assigned to the present assignee, the use of a generally continuous starting voltage 47, rather than a periodic spike of voltage, enables the peak starting voltage to be considerably lower. The foregoing patent teaches, for instance, that the period between consecutive maxima of the periodic starting waveform is preferably maintained below the deionization constant of plasma in the arc tube. However, periodic spikes of voltage could be used instead, by way of example.

Figure 2C:
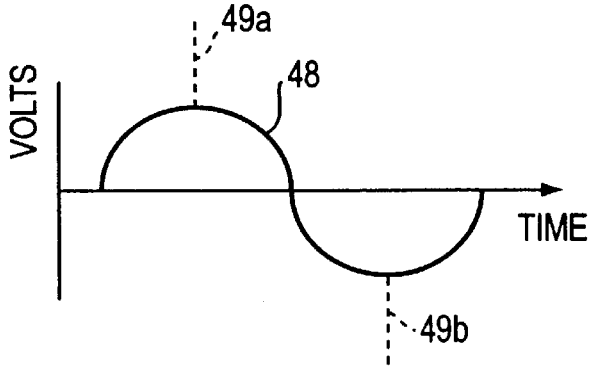

Alternatively, as shown in FIG. 2C, the ballast circuit could supply a ballast signal having a low frequency component 48, shown as a solid line, with a typical frequency of 60 hertz, and also having substantially higher frequency components or spikes 49*a* and 49*b*, shown in dashed lines, which preferably coincide with the positive and negative peaks low frequency component 48. As in FIG. 2B, the magnitude of high frequency components 49*a* and 49*b* are shown greatly reduced for ease of illustration. The high frequency components are used for starting the lamp; the low frequency component, for powering the lamp in normal operation.

FIG. 3 shows a starting aid 50 for implementing aid 18 of FIG. 1. Aid 50 comprises an elongated arc tube containing a low pressure gas fill 52. It should be spaced sufficiently from main arc tube 10 to prevent its pressure from rising too high to prevent its ionization as a result of thermal heating from the main arc tube. The arc tube serves as a barrier to electrons, to prevent the above-mentioned deleterious sodium-leaching effect of photoelectrons. The size of the arc tube, the materials comprising the fill and its pressure are chosen to provide an appropriate electrical resistance to prevent destructive current in the aid, while achieving the starting function described in connection with FIG. 1. These values will be apparent to those of ordinary skill in the art. For instance, gas fill 52 may comprise on the order of 10–50 Torr of argon or other gas more easily ionizable than the gas within the main arc tube.

Figure 7:
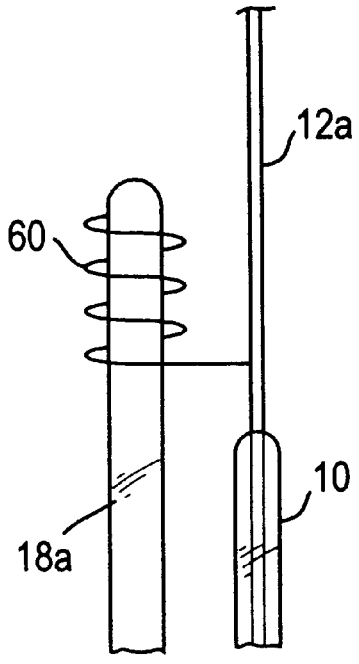
FIGS. 7–10 are fragmentary view of arrangements for coupling an end of a starting aid to in-leads of the main arc tube.
Figure 8:
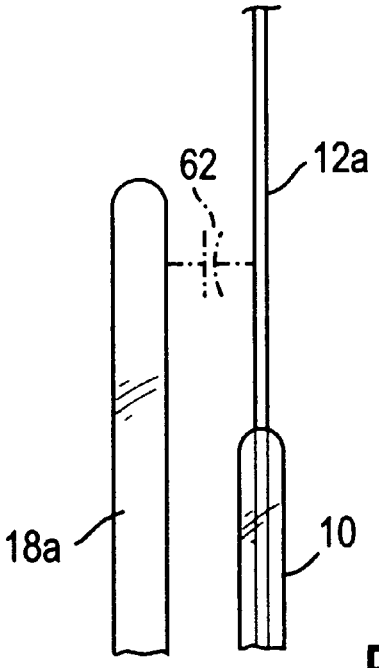

FIG. 7 shows a preferred arrangement for coupling aid 50 (shown as aid 18*a*) to the in-leads of lamp 10. A metallic wire 60 depends from in-lead 12*a*, and is coiled around the upper shown end of aid 18*a*. Referring to FIG. 8, such wire forms an inherent capacitive coupling between the aid and in-lead 12*a*, while mechanically holding the aid in relation to the in-lead. Preferably, the other end of the aid is connected to the other in-lead 14*a* in the same manner as shown in FIG. 7. The capacitance value of the capacitive coupling is chosen to selectively allow high frequency starting current to flow in aid 50, but to block the low frequency current used for operating the main arc tube 10, and will be apparent to those of ordinary skill in the art.

FIG. 4A shows a starting aid 64 comprising a vitreous tube 64 over a wire 66. Tube 64 may be formed of glass, ceramic or quartz, for instance, as long as it serves as a barrier to electrons. Wire 66 could be in the form of a helix, as shown, so that it touches the inner wall of the tube 64. In such position, the wire can bleed off photoelectrons from the inner wall of the vitreous tube which collect there after being emitted from the wire. Starting aid 64 of FIG. 4A can be capacitively coupled to the in-leads of arc tube 10 (Fig. 1) in the manner shown in FIGS. 7 or 8.

Figure 9:
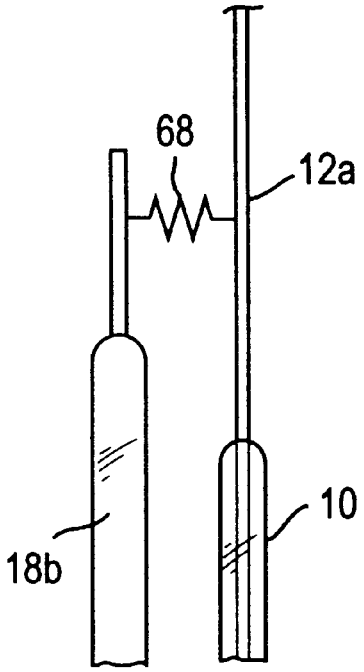
Figure 10:
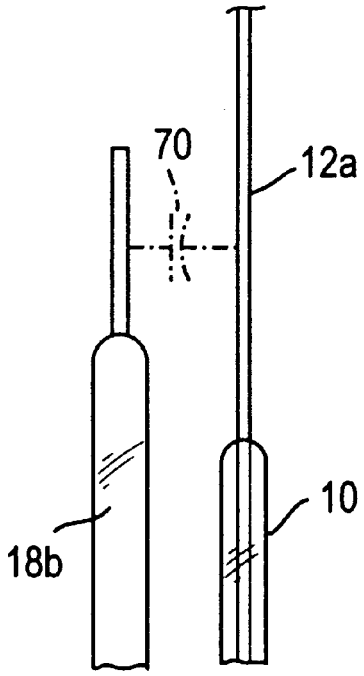

FIG. 4B varies from FIG. 4A by showing an aid 65, similar to aid 64, but whose wire 66 extends from the ends of the aid as wire portions 66*a* and 66*b*. The wire portions are preferably coupled to the in-leads of the main arc tube 10 through a resistance 68 as shown in FIG. 9, or by an inherent capacitive coupling 70 as shown in FIG. 10.

In either the FIG. 4A or FIG. 4B embodiments, the electrical resistance of the aid and its couplings should be chosen to prevent destructive current from flowing through the aid. For these embodiments, the resistance of wire 66 is preferably at least about 5,000 ohms, and more preferably at least about 10,000 ohms. Such selection of values will be apparent to those of ordinary skill in the art.

FIG. 5A shows a wire 72 ensheathed by an electron barrier 74, such as a plasma-sprayed ceramic. It may be capacitively coupled to the electrodes of main arc tube 10 as shown in FIGS. 7 and 8.

FIG. 5B varies from FIG. 5A by showing an aid 75, similar to aid 74 but whose wire 72 extends from one end of the aid as wire portion 72*a*. FIG. 5C varies from FIG. 5B by showing an aid 77, similar to aid 75 but whose wire 72 extends from both ends of the aid as wire portions 72*a* and 72*b*. The wire portions of FIGS. 5B and 5C are preferably coupled to the in-leads of the main arc tube 10 through a resistance 68 as shown in FIG. 9, or by an inherent capacitive coupling 70 as shown in FIG. 10; and the right-hand end of aid 75 (FIG. 5B) can be coupled to an in-lead of the main arc tube in the manner shown in FIGS. 7 or 8.

The resistance of the wire 72 in FIGS. 5A–5C may be as described above for wire 66 of FIGS. 4A or 4B.

FIG. 6 shows a starting aid 78 comprising a quartz lamp with a resistive element 79 sealed within a quartz tube 80. The lamp is "double-ended" in the sense that its in-leads 79*a* and 79*b* enter the quartz tube from separate ends of the lamp, rather Man a single end. The quartz tube 80 serves as a barrier to electrons.

Coupling of the in-leads 79*a* and 79*b* to in-leads 12*a* and 14*a* of the main arc tube 10 is preferably accomplished with an inherent capacitive coupling such as shown in FIG. 8. By using a capacitive coupling, low frequency operating current for the main arc tube is not diverted into the starting aid, where it could destroy the aid. The wattage of lamp 78 may typically be on the order of several hundreds of watts; such wattage is chosen to facilitate starting of the main arc tube as described above while preventing destructive levels of current in the aid. A suitable selection of values will be apparent to those of ordinary skill in the art.

Referring again to FIGS. 7, 8 and 10, the spacing between starting aid 18*a* and in-lead 12*a* (or 14*a*) is selected to result in the desired degree of capacitive coupling, and, thus, will typically be less than as shown in those figures.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A high intensity discharge lamp, comprising:

(a) an elongated main arc tube containing a gas fill;

(b) first and second in-leads connected to first and second electrodes within said arc tube, with an arc gap being defined in said arc tube between said electrodes;

(c) said first and second in-leads adapted to be connected to first and second power leads of a ballast circuit; and (d) a starting aid for said main arc tube comprising:

(i) a path generally parallel to said main arc tube along said arc gap and which is conductive during starting of said main arc tube;

(ii) an electron barrier disposed between at least all confronting surfaces of coextensive, substantial lengths of said path and said main arc tube for preventing a substantial amount of photoelectrons from collecting on an outer surface of said main arc tube; and (iii) first and second ends of said path being coupled to said first and second in-leads by first and second electrical couplings.

2. The lamp of claim 1, wherein:

(a) said starting aid comprises a low pressure arc tube; and (b) at least one of said first and second couplings comprises a frequency-dependent coupling for preventing current through said starting aid at a first frequency at which said main arc tube normally operates but for enabling current therethrough at a substantially higher frequency;

(c) said low pressure arc tube comprising a conductive path therein upon energization at said substantially higher frequency;

(d) the material forming said low pressure arc tube serving as said electron barrier.

3. The lamp of claim 2, wherein said first and second couplings each comprises a wire connected to one of said first and second in-leads, and which is wrapped around one of first and second ends of said low pressure discharge tube.

4. The lamp of claim 2, wherein an interior said low pressure arc tube has an interior lacking any electrodes.

5. The lamp of claim 1, wherein said starting aid comprises a metallic conductor ensheathed in said electron barrier.

6. The lamp of claim 5, wherein said metallic conductor comprises:

(a) an electron barrier with a generally cylindrical inner wall; and (b) a helically shaped conductor whose axially outer surface is proximate to said inner wall.

7. The lamp of claim 5, wherein said metallic conductor has a resistance at least about 5,000 ohms.

8. The lamp of claim 1, wherein:

(a) said starting aid comprises an incandescent lamp; and (b) at least one of said first and second couplings comprises a frequency-dependent coupling for preventing current through said starting aid at a first frequency at which said main arc tube normally operates but for enabling current therethrough at a substantially higher frequency.

9. The lamp of claim 1, wherein said gas fill includes metal halide.

10. A high intensity metal halide discharge lamp, comprising:

(a) an elongated, main arc tube containing a gas fill with metal halide;

(b) first and second in-leads connected to first and second electrodes within said arc tube, with an arc gap being defined in said arc tube between said electrodes;

(c) said first and second in-leads adapted to be connected to first and second power leads of a ballast circuit; and (d) a starting aid for said main arc tube comprising:

(i) a path generally parallel to said main arc tube, extending along said arc gap for at least about 75 percent of said arc gap, and which is conductive during starting of said main arc tube;

(ii) an electron barrier disposed between said path and said main arc tube for preventing a substantial amount of photoelectrons from collecting on an outer surface of said main arc tube; and (iii) first and second ends of said path being coupled to said first and second in-leads by first and second electrical couplings.

11. The lamp of claim 8, wherein said path extends along said arc gap for at least about 90 percent of said arc gap.

12. The lamp of claim 10, wherein:

(a) said starting aid comprises a low pressure arc tube; and (b) at least one of said first and second couplings comprises a frequency-dependent coupling for preventing current through said starting aid at a first frequency at which said main arc tube normally operates but for enabling current therethrough at a substantially higher frequency;

(c) said low pressure arc tube comprising a conductive path therein upon energization at said substantially higher frequency;

(d) the material forming said low pressure arc tube serving as said electron barrier.

13. The lamp of claim 12, wherein said first and second couplings each comprises a wire connected to one of said first and second in-leads, and which is wrapped around one of first and second ends of said low pressure discharge tube.

14. The lamp of claim 8, wherein said starting aid comprises a metallic conductor ensheathed in said electron barrier.

15. The lamp of claim 14, wherein said metallic conductor comprises:

(a) an electron barrier with a generally cylindrical inner wall; and (b) a helically shaped conductor whose axially outer surface is proximate to said inner wall.

16. The lamp of claim 14, wherein said metallic conductor has a resistance at least about 5,000 ohms.

17. The lamp of claim 10, wherein:

(a) said starting aid comprises an incandescent lamp; and (a) at least one of said first and second couplings comprises a frequency-dependent coupling for preventing current through said starting aid at a first frequency at which said main arc tube normally operates but for enabling current therethrough at a substantially higher frequency.

18. A high intensity discharge lamp, comprising:

(a) an elongated, main arc tube containing a gas fill;

(b) first and second in-leads connected to first and second electrodes within said arc tube, with an arc gap being defined in said arc tube between said electrodes;

(c) said first and second in-leads adapted to be connected to first and second power leads of a ballast circuit; and (d) a starting aid for said main arc tube comprising:

(i) a path generally parallel to said main arc tube along said arc gap and which is conductive during starting of said main arc tube;

(ii) an electron barrier disposed between said path and said main arc tube for preventing a substantial amount of photoelectrons from collecting on an outer surface of said main arc tube; and (iii) first and second ends of said path being coupled to said first and second in-leads by first and second electrical couplings;

(iv) at least one of said first and second couplings comprising a frequency-dependent coupling for preventing current through said starting aid at a first frequency at which said main arc tube nominally operates but for enabling current therethrough at a substantially higher frequency.

19. The lamp of claim 18, wherein said gas fill includes metal halide.

20. The lamp of claim 18, wherein:

(a) said starting aid comprises a low pressure arc tube having an interior lacking any electrodes;

(b) said low pressure arc tube comprising a conductive path therein upon energization at said substantially higher frequency; and (c) the material forming said low pressure tube serving as said electron barrier.

21. The lamp of claim 20, wherein said gas fill includes metal halide.

22. The lamp of claim 20, wherein at least one of said first and second couplings comprises a wire connected to one of said first end second in-leads, and which is wrapped around one of first and second ends of said low pressure discharge tube.

23. The lamp of claim 18, wherein said starting aid comprises a metallic conductor ensheathed in said electron barrier.

24. The lamp of claim 23, wherein said metallic conductor comprises:

(a) an electron barrier with a generally cylindrical inner wall; and (b) a helically shaped conductor whose axially outer surface is proximate to said inner wall.

25. The lamp of claim 23, wherein said metallic conductor has a resistance at least about 5,000 ohms.

26. The lamp of claim 23, wherein said gas fill includes metal halide.

* * * * *